US008234965B2

(12) United States Patent
Ravid et al.

(10) Patent No.: US 8,234,965 B2
(45) Date of Patent: Aug. 7, 2012

(54) ARMOR PLATE

(75) Inventors: Moshe Ravid, Hod Hasharon (IL); Avram Ya'akobovich, Haifa (IL)

(73) Assignee: Plasan Sasa Ltd., M.P. Marom Hagalil (IL)

( * ) Notice: Subject to any disclaimer, the term of this patent is extended or adjusted under 35 U.S.C. 154(b) by 224 days.

(21) Appl. No.: 12/646,626

(22) Filed: Dec. 23, 2009

(65) Prior Publication Data

US 2010/0170387 A1 Jul. 8, 2010

(30) Foreign Application Priority Data

Dec. 25, 2008 (IL) ..... 196191

(51) Int. Cl.
*F41H 5/02* (2006.01)
*F41H 7/00* (2006.01)

(52) U.S. Cl. ..... 89/36.02; 89/36.07; 89/904; 428/911; 109/49.5

(58) Field of Classification Search ..... 89/36.01–36.15; 428/911; 109/49.5
See application file for complete search history.

(56) References Cited

U.S. PATENT DOCUMENTS

| | | | | |
|---|---|---|---|---|
| 3,421,200 | A * | 1/1969 | Gregory | 228/182 |
| 5,014,593 | A | 5/1991 | Auyer et al. | |
| 5,221,807 | A | 6/1993 | Vives | |
| 6,408,734 | B1 | 6/2002 | Cohen | |
| 6,575,075 | B2 | 6/2003 | Cohen | |
| 7,383,762 | B2 | 6/2008 | Cohen | |
| 7,513,186 | B2 * | 4/2009 | Ravid et al. | 89/36.02 |
| 7,712,407 | B2 * | 5/2010 | Ravid et al. | 89/36.01 |
| 8,015,909 | B2 * | 9/2011 | Ravid et al. | 89/36.01 |
| 2004/0020353 | A1 * | 2/2004 | Ravid et al. | 89/36.02 |
| 2005/0257677 | A1 | 11/2005 | Ravid et al. | |
| 2006/0213360 | A1 | 9/2006 | Ravid et al. | |
| 2007/0003407 | A1 | 1/2007 | Turner et al. | |
| 2009/0293711 | A1 * | 12/2009 | Altergott et al. | 89/36.02 |
| 2010/0162884 | A1 * | 7/2010 | Ravid et al. | 89/36.02 |

FOREIGN PATENT DOCUMENTS

| | | |
|---|---|---|
| EP | 1 128 154 A2 | 8/2001 |
| IL | 115397 | 9/1995 |

* cited by examiner

*Primary Examiner* — Michael David
(74) *Attorney, Agent, or Firm* — The Nath Law Group

(57) ABSTRACT

An armor plate for use in the ballistic protection of a structure against projectiles incoming from an expected threat direction, the plate having an outer face facing the threat direction and comprising a layer of first pellets made of ballistic material of a high density $S_1$ and having a characteristic diameter $D_P$, and second pellets which have a low density section with a central axis transverse to the outer face, along which the low density section at least partially extends, the low density section of the second pellets having a density $S_2$ which is in the range $0 \leqq S_2 << S_1$, the second pellets having an outer characteristic diameter $D_{OUT}$ substantially equal to the diameter $D_P$ and the low density section having an inner characteristic diameter $D_{IN}$, $D_{IN} < D_{OUT}$, each second pellet being surrounded only by the first pellets.

18 Claims, 3 Drawing Sheets

ARMOR PLATE

FIELD OF THE INVENTION

This subject matter relates to ballistic armor and, particularly, to such armor, which is adapted for use as an exterior armor for military vehicles

BACKGROUND OF THE INVENTION

There is known ballistic armor of a kind having a basic, main armor and an additional, auxiliary armor panel in the form of a perforated or slit plate, normally made of steel or other ballistic material, installed at a stand-off distance from the main armor, designed to effectively break an incoming projectile or at least to divert it from its incident trajectory and thus substantially reduce its residual penetration capability through the basic armor.

Examples of armor using at least partially perforated plates are disclosed in U.S. Pat. Nos. 5,014,593, 5,221,807, EP 1,128,154, US2006/0213360 and US2005/0257677.

There are also known armor plates having a layer of cylindrical ceramic pellets with voids therebetween, and IL 115397 discloses the use of one such plate in a multilayer armor panel.

U.S. Pat. No. 6,408,734 discloses the use of an armor plate of the kind disclosed in IL 115397, and suggests filling replacing some of the pellets with elements having protrusions entering voids between adjacent pellets, these elements being made of the same ceramic material as the pellets.

U.S. Pat. No. 6,575,075 discloses an armor plate similar to that disclosed in IL 115397 made a layer of ceramic pellets, each having a channel oriented perpendicularly to the plate's front surface, to reduce the weight of the armor plate.

SUMMARY OF THE INVENTION

In accordance with one aspect of the present subject matter, there is provided an armor plate for use in the ballistic protection of a structure against projectiles incoming from an expected threat direction. The plate has an outer face facing the threat direction and comprises a layer of first pellets made of ballistic material of a high density $S_1$ and of a characteristic diameter $D_P$, and second pellets which have a low density section with a central axis transverse to the outer face of the plate. The low density section at least partially extends along the central axis and has a density $S_2$ which is in the range $0 \leqq S_2 << S_1$. The second pellets have an outer characteristic diameter $D_{OUT}$ substantially equal to the diameter $D_p$ and the low density section has an inner characteristic diameter $D_{IN}$, $D_{IN} < D_{OUT}$. Each second pellet is surrounded only by the first pellets.

In the present application, the term 'characteristic diameter' of a pellet or its part refers to a cross-section of the pellet taken perpendicular to its central axis, and means

- just a diameter, in case of a circular shape of the cross-section of the pellet, or
- diameter of the largest inscribed circle, in case of a non-circular shape of the cross-section.

The term "ballistic material" means a hard material capable of resistance to penetration by a projectile.

The low density section in each of the second pellets may be formed at any location thereof, and it may for example be in the form of hole or channel in the second pellet. In the latter case, the second pellets may have hollow bodies, with a hole at least partially extending along its central axis. In particular, the hole may be a through going hole. In this case, the density of the low density region will be zero.

The plate is intended for use in the ballistic protection of a structure at least against projectiles having a caliber $D_C$, and the characteristic diameter $D_{IN}$ may be about $D_C$, particularly not greater than $D_C$, and still more particularly, smaller than $D_C$.

The first and second pellets may be of any shape that allows the pellets to be closely packed in the ballistic. In particular, the second pellets may have the same external shape as the first pellets, which shape may for example be cylindrical or hexagonal, allowing closest packaging of the pellets.

The second pellets may have a length/height smaller or equal to that of the first pellets.

The first pellets comprise a front and a rear end, and one or each of these ends may for example be convexly curved or planar.

The central axis of the low density section may be perpendicular to the outer face of the plate or inclined with respect thereto.

The first and second pellets in the layer preferably have a regular arrangement of parallel rows. At least a part of these rows are combined rows each comprising the first and the second pellets. Each of the combined rows may have adjacent thereto at least one uniform row comprising only the first pellets.

The plate may comprise a binder matrix enveloping the first and second pellets and holding them in the desired arrangement.

The first pellets may be made of any appropriate ballistic material such as for example ceramics, and the second pellets may be made of ballistic material of a lower density than that of the first pellets, e.g. of a metal such as ballistic aluminum alloy or the like, or of non-ballistic material, for example non-ballistic metal or plastic. In this context, the term "non-ballistic material" means a material uncapable of resistance to penetration by a projectile.

The weight of each second pellet preferably does not exceed, and in particular is lower than, that of each first pellet. The weight difference between the first and second pellets may be due to any one of the following features of the pellets or a combination of any of them:

- material of the second pellet having lower density than that of the first pellets,
- the second pellet having through holes; and
- the pellets having different dimensions, in particular, height.

In consequence with the above weight difference between the first and second pellets, the weight of the plate of the present subject matter is essentially lower that that of a conventional perforated plate which is not made of pellets but is rather in the form of a solid, metal, plate, e.g. made of steel, having the same thickness and the same arrangement and geometry of holes, and the difference in the weights of the former and the latter plates may be up to 50%, more particularly up to 40%, and still more particularly up to 35%. The weight of the plate is of a great importance since it is meant to be carried by a vehicle and, therefore, a plate having a lower weight is preferred to a plate of greater weight which provides the same ballistic protection.

In accordance with another aspect of the present subject matter, there is provided an armor system for the ballistic protection of a structure against projectiles incoming from an expected threat direction. The armor system includes a basic, main armor layer and an additional, auxiliary armor layer in the form of an armor plate as described above, mounted in front of the main armor layer, in the threat direction, at a stand-off distance therefrom. Main armor plate in this context is an armor plate mounted closest to the structure to be protected or resident therein. A wall of the structure may be also a main armor plate or part thereof.

In accordance with another aspect of the present subject matter, there is provided a vehicle having at least one region that comprises a plate described above. The region may be in a side wall and/or track of the vehicle and may be free of any other armor.

BRIEF DESCRIPTION OF THE DRAWINGS

In order to understand the subject matter and to see how it may be carried out in practice, embodiments will now be described, by way of non-limiting examples only, with reference to the accompanying drawings, in which.

DETAILED DESCRIPTION OF EMBODIMENTS

Figure 1A:
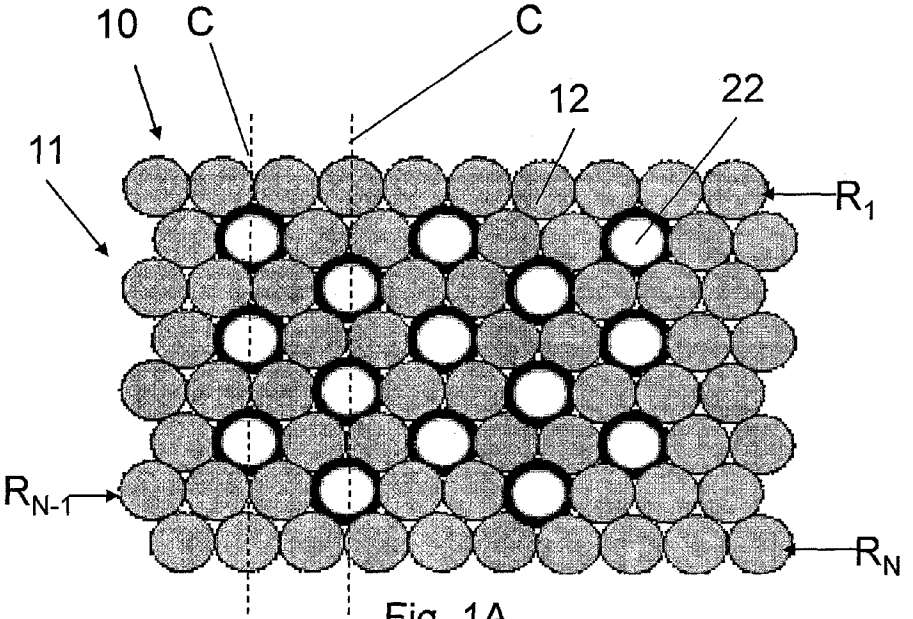
FIG. 1A is a front view of an armor plate according to one embodiment of the present subject matter.
Figure 1B:
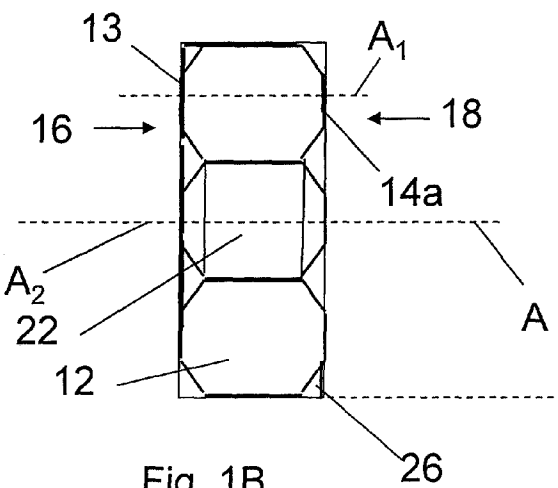
FIG. 1B is a top view of a portion of the armor plate shown in FIG. 1A.
Figure 1C:
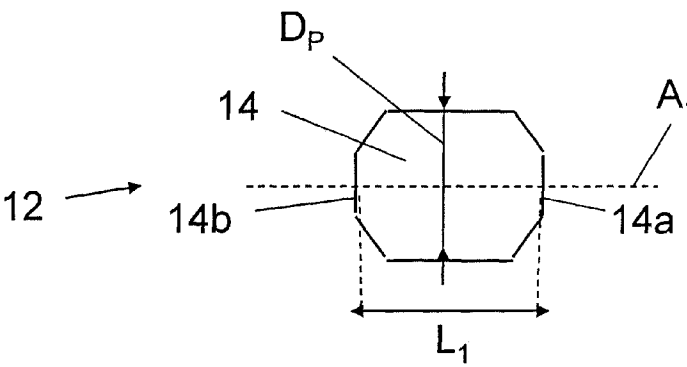
FIG. 1C is a cross-sectional view of a pellet used in the armor plate shown in FIGS. 1A and 1B, taken along its central axis $A_1$.
Figure 1D:
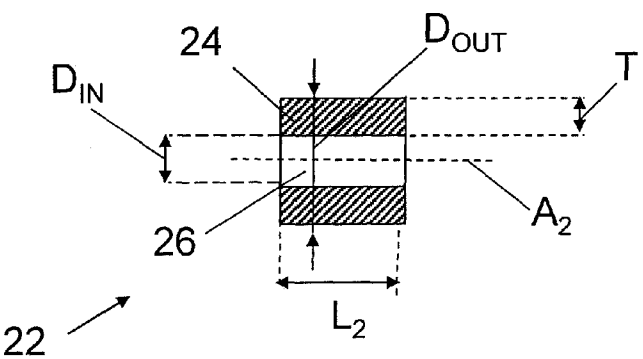
FIG. 1D is a cross-sectional view of a hollow pellet used in the armor plate shown in FIGS. 1A and 1B, taken along its central axis $A_2$.
Figure 2:
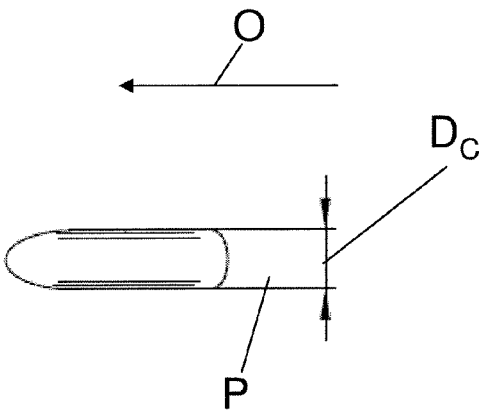
FIG. 2 is a front view of an armor plate according to another embodiment of the present subject matter.
Figure 2:
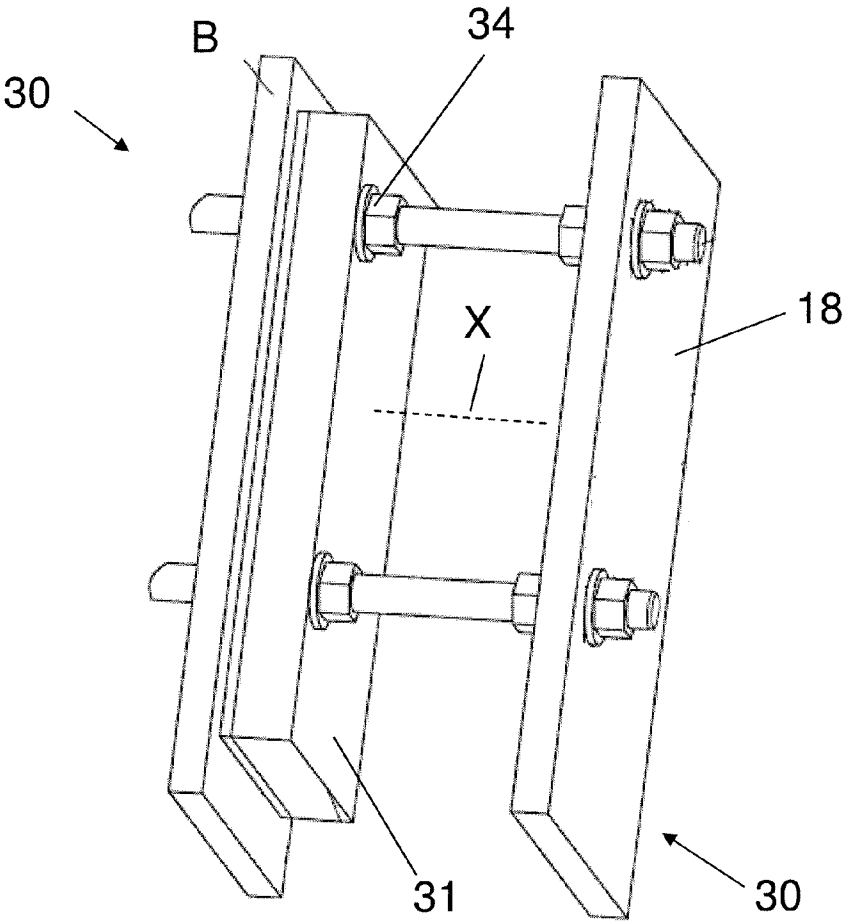

FIGS. 1A to 1C show one example of an armor plate 10 according to the present subject matter, designed, as will be further described in detail, constructed for use in ballistic protection of a basic structure B, e.g. a side wall of a vehicle, against projectiles P having a caliber $D_C$ and coming from an expected threat direction O (as shown in FIG. 2).

The plate 10 comprises a layer 11 of first, solid pellets 12 and second, hollow pellets 22, wrapped by a wrapping material 13. The plate 10 has an inner face 16, an outer face 18, and it will further be described with reference to an axis A extending along the thickness of the plate between its inner and the outer faces 16 and 18, respectively.

The pellets 12 are made of a high density ballistic armor material, e.g., ceramic, such as for example alumina, silicon carbide, silicone nitride, boron carbide or the like. With reference to FIG. 1C, each pellet 12 is of a length $L_1$ and has a cylindrical body 14 of a diameter $D_P$, a front end 14*a*, a rear end 14*b* and a central axis of symmetry $A_1$. The front and rear ends 14*a* and 14*b* of the pellet 12 are chamfered, though this does not necessarily need to be the case.

The hollow pellets 22 may be made of a material having a lower density such as aluminum alloy, titanium alloy, other metal alloy or strong plastic material. Each hollow pellet 22 has a body 24 of an outer diameter $D_{OUT}$ and a length $L_2$, a central axis $A_2$ and a through hole 26 extending along the axis $A_2$, of an inner diameter $D_{IN}$. The outer diameter $D_{OUT}$ is substantially equal to the diameter $D_P$ of the pellets 12, and the inner diameter $D_{IN}$ satisfies the condition $D_{IN}<D_C$, where $D_C$ is the caliber of those of the projectiles against which the plate 10 is to be effective (as will be explained in more detail below). The thickness T of the hollow pellets 22, which equals the difference between their outer and inner diameters, may be of such that the hollow pellets may be considered thin-walled cylinders. For example, T may be in the range of 0.45-0.55 mm, and more particularly 0.49-0.51 mm. The length $L_2$ of the hollow pellets substantially satisfies the condition $L_2 \leqq L_1$.

When arranged in the layer 11 within the wrapping 13, as shown in FIG. 1B, the front ends 14*a* of the pellets 12 face the outer face 18 of the plate 10. The solid pellets 12 and the hollow pellets 22 are arranged so that their respective axes $A_1$ and $A_2$ are parallel to the axis A of the plate 10.

In the present example, the solid pellets 12, the hollow pellets 22, and the through holes 26 in the solid pellets 22 are all cylindrical, i.e. have all circular shape in their central cross-section, which is a cross-section taken perpendicular to their central axes. However, the solid and hollow pellets and the through holes in the hollow pellets may have any other appropriate shapes, the same or different, in which case the diameters indicated above will be their characteristic diameters, i.e. the diameters of imaginary circles inscribed therein in their central cross-sections (not shown).

The layer 11 of the solid pellets 12 and the hollow pellets 22 has a regular arrangement of the pellets in N parallel rows R. In the example shown in FIG. 1, all the rows, except the edge rows $R_1$ and $R_N$, comprise both the solid pellets 12 and the hollow pellets 22. The edge rows $R_1$ and $R_N$ comprise only solid pellets 12. In each of the rows $R_2$ to $R_{N-1}$, each hollow pellet 22 is spaced from a hollow pellet 22 closest thereto, by two solid pellets 12. Arranged in this manner, the hollow pellets 22 form non-continuous columns aligned along imaginary parallel lines C.

Each of the hollow pellets 22 in the rows $R_2$ to $R_{N-1}$ is surrounded by solid pellets 12 only. In the present example, where the arrangement of the pellets is hexagonal, each hollow pellet 22 has six solid pellets 12 therearound. However, if the arrangement of the pellets was, for example, square (not shown), each hollow pellet would be surrounded by four solid pellets.

The plate 10 described above has a weight W, which substantially satisfies the condition: $W \leqq 0.67\ W_R$, where $W_R$ is a weight of a reference plate (not shown) in which all the hollow pellets 22 are replaced with the solid pellets 12. In the present example the above ratio yields a weight difference of about 6.8 kg/m$^2$ between the plate 10 and the reference plate. When comparing the plate 10 to a conventional perforated plate made of steel, e.g. a standard steel perforated plate of a thickness about 8 mm and a weight of about 37 kg/m$^2$, having the same or similar arrangement and geometry of holes as that of the plate 10, the weight reduction may be up to 50%.

Figure 3:
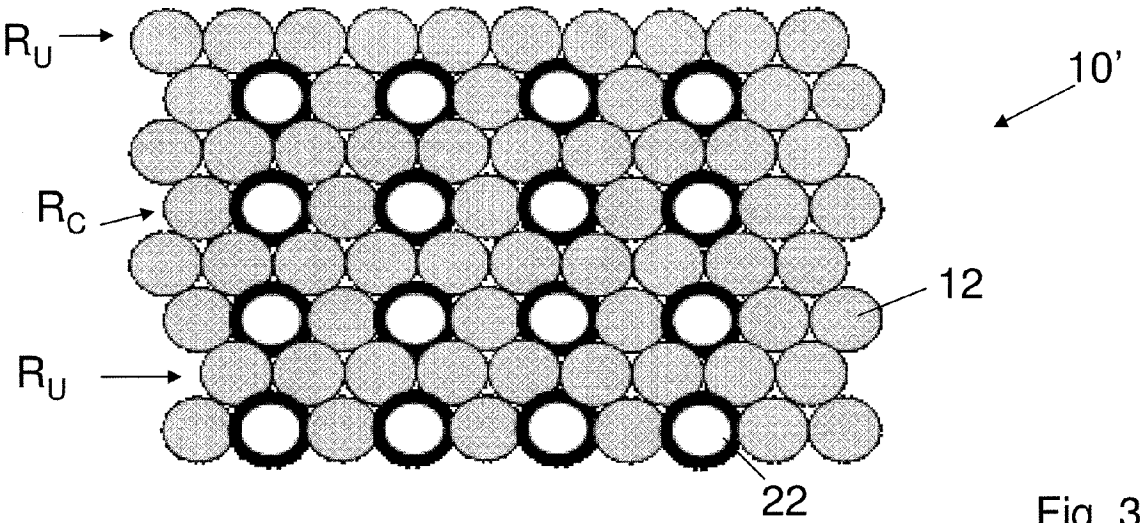
FIG. 3 is a front view of an armor plate according to a still further embodiment of the present subject matter.

The number of solid pellets disposed between each adjacent hollow pellets in the armor plate 10 and their arrangement in the rows may differ. Two examples of such alternative designs of the plate 10 are shown in FIGS. 2 and 3.

FIG. 2 shows another example of an armor plate 10' according to the present subject matter. The plate 10' differs from the plate 10 by the arrangement of the solid pellets 12 and the hollow pellets 22 in the layer 11. The plate comprises combined rows $R_C$ having both solid pellets 12 and hollow pellets 22, and uniform rows $R_U$ having only hollow pellets 12. Each combined row $R_C$ has two adjacent uniform rows $R_U$.

The hollow pellets 22 in the plate 10' are spaced from one another along the combined rows $R_C$ by one solid pellet 12. In addition, all the combined rows $R_C$ are similarly arranged, i.e. the locations of the hollow pellets 22 is similar in all the combined rows $R_C$.

Similarly to the plate 10, each of the hollow pellets 22 in the plate 10' is surrounded by the solid pellets 12. The weight W' of the plate 10' substantially satisfies the condition:

$W'=W_R \leqq 0.75$ W, where $W_R$ is the weight of the reference plate mentioned above. In the present example the above ratio yields a weight difference of about 5 kg/m$^2$ between the plate 10' and the reference plate.

FIG. 3 shows another example of an armor plate 10" according to the present subject matter. The plate 10" has essentially the same arrangement as the plate 10' and differs therefrom only by the fact that the hollow pellets 22 in each combined row $R_C$ are staggered with respect to the hollow pellets 22 in one or both the adjacent combined row(s) $R_C$. Consequently, a weight W" of the plate 10" is substantially equal to the weight W' of the plate 10'.

The plate 10 according to any design described above further comprises a binder matrix 26 (FIG. 1B), which envelopes the solid and hollow pellets and is adapted to retain their arrangement in the array. The matrix may be made of thermoplastic or thermoset material.

The plate 10 may be produced by a process disclosed in US 2007/003407 to the Applicant, the description of which is incorporated herein by reference, with the differences being mainly that, during the arrangement of the solid pellets 12 in a cavity of a mold, within the wrapping material 13 covering the cavity's walls, the hollow pellets 22 are inserted between the solid pellets 12, instead of the pellets 12, according to the arrangement described above; and in that the plate 10 does not have any additional layers (except for the wrapping) such as a backing layer.

Figure 4:
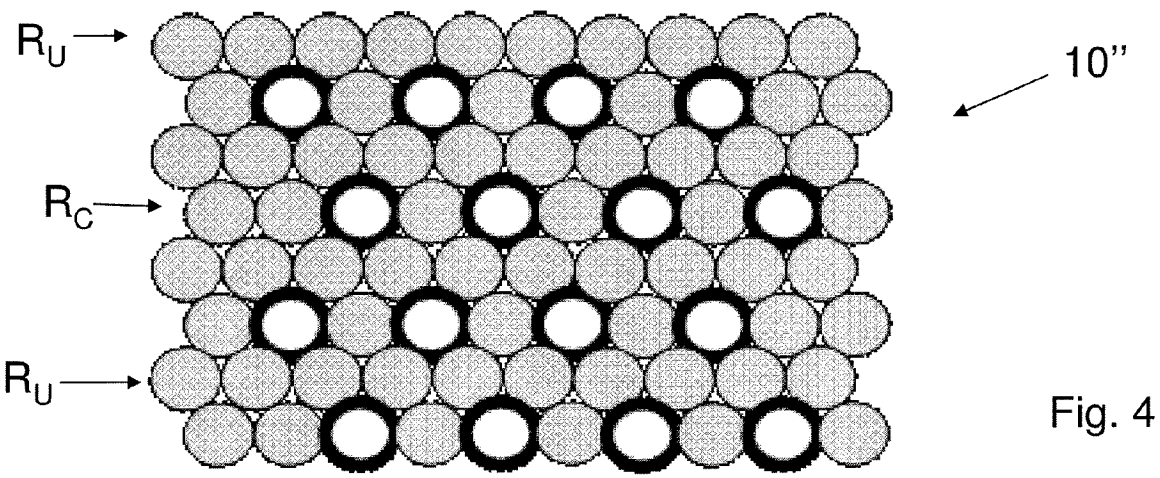
FIG. 4 is a schematic perspective view of an armor system according to an embodiment of the present subject matter.

As shown in FIG. 4, the plate 10 may be used as a part of an armor assembly 28 which also includes a main armor plate 31, the assembly being designed to protect the structure B from incoming projectiles P. In case the projectiles P have a range of calibers, the diameter of the holes $D_{IN}$ may be established as described above based on the smallest caliber $D_C$. Alternatively, the diameter of the holes may be established based on a caliber which is greater than the smallest caliber in the range, in which case the armor assembly may be of the kind described in the Applicant's patent applications Nos. US2006/0213360 and US2005/0257677, whose contents are incorporated herewith by reference.

In particular, in this assembly 28, the plate 10 constitutes an auxiliary plate 30, which is located in front of the main armor plate 31 being spaced therefrom to a predetermined stand-off distance X, so that the outer face 18 of the plate 30 faces the expected threat direction O. The armor assembly 28 may be attached to the structure B by bolts 34 which may be the same bolts that hold the auxiliary plate 30 at the distance X from the main plate 31.

The auxiliary plate 30 is designed to deflect and shatter or at least to destabilize the projectiles P impacting thereon having a range of calibers. If the main armor 31 is designed so that it cannot stop alone or together with the structure B, any of the projectiles P, the inner diameter $D_{IN}$ of the hollow pellets 22 should satisfy the condition $D_{IN}<D_S$, where $D_s$ is the smallest caliber in the range. However, if the main armor plate alone or together with the structure B, can stop the projectiles of the minimal caliber $D_M$, the hollow elements 22 may have their holes' inner diameter $D_{IN}$ greater than $D_M$ but less than $D_G$, where $D_G$ is a caliber greater than the smallest caliber in the range.

The armor plate 10 may also be used without the main plate described above, and this particularly concerns areas in armored vehicles, such as a track, where there is no space available for the incorporation of the main armor.

Those skilled in the art to which this subject matter pertains will readily appreciate that numerous changes, variations, and modifications can be made without departing from the scope of the subject matter, mutatis mutandis

The invention claimed is:

1. An armor plate for use in the ballistic protection of a structure against projectiles incoming from an expected threat direction, the plate having an outer face facing the threat direction and comprising a layer of first pellets made of ballistic material of a high density $S_1$ and having a characteristic diameter $D_P$, and second pellets which have a low density section with a central axis transverse to the outer face, along which the low density section at least partially extends, the low density section of the second pellets having a density $S_2$ which is in the range $0 \leqq S_2 << S_1$, the second pellets having an outer characteristic diameter $D_{OUT}$ substantially equal to the diameter $D_P$ and the low density section having an inner characteristic diameter $D_{IN}$, $D_{IN}<D_{OUT}$, wherein the second pellets are in the form of hollow pellets in which the central region is in the form of a hole at least partially extending along its central axis wherein each hole is a through hole, each second pellet being surrounded only by the first pellets.

2. An armor plate according to claim 1, wherein the plate is intended for use in the ballistic protection of a structure at least against projectiles having a caliber $D_C$ and wherein the characteristic diameter $D_{IN}$ is at least not greater, and preferably is smaller than the caliber $D_C$.

3. An armor plate according to claim 1, wherein the central axis is perpendicular to the outer face of the plate.

4. An armor plate according to claim 1, wherein the first and second pellets in the layer have a regular arrangement of parallel rows.

5. An armor plate according to claim 4, wherein at least a part of the rows are combined rows each comprising the first and the second pellets.

6. An armor plate according to claim 4, wherein at least a part of the rows are uniform rows each comprising only the first pellets.

7. An armor plate according to claim 6, wherein each of the combined rows has at least one uniform row adjacent thereto.

8. An armor plate according to claim 1, further comprising a binder matrix enveloping the first and second pellets and keeping them in their predetermined arrangement.

9. An armor plate according to claim 1, wherein the second pellets have the same external shape as the first pellets.

10. An armor plate according to claim 1, wherein the first and second pellets have a cylindrical or hexagonal external shape, in their cross-section parallel to the outer face of the plate.

11. An armor according to claim 1, wherein a length of the first pellets is greater than the length of the second pellets in their cross-section perpendicular to the outer face of the plate.

12. An armor according to claim 1, wherein a length of the first pellets is equal to the length of the second pellets in their cross-section perpendicular to the outer face of the plate.

13. An armor plate according to claim 1, wherein a weight of each second pellet does not exceed that of each first pellet.

14. An armor plate according to claim 13, wherein the weight of each second pellet is lower than that of each first pellet.

15. A vehicle including at least one region comprising a plate according to claim 1.

16. A vehicle according to claim 15, wherein the region is a side wall.

17. A vehicle according to claim 15, wherein the region is a track.

18. A vehicle according to claim 15, wherein the region is free of any other armor.

* * * * *